US008257232B2

(12) United States Patent
Albert

(10) Patent No.: US 8,257,232 B2
(45) Date of Patent: Sep. 4, 2012

(54) DEVICE FOR THE REEDUCATION OF MOTORY DEFICIENCIES, PARTICULARLY DEFICIENCIES WHEN WALKING, IN PATIENTS

(75) Inventor: Thierry Albert, Joinville le Pont (FR)

(73) Assignee: Christian Salaun, Meudon (FR)

( * ) Notice: Subject to any disclaimer, the term of this patent is extended or adjusted under 35 U.S.C. 154(b) by 823 days.

(21) Appl. No.: 11/597,542

(22) PCT Filed: May 24, 2005

(86) PCT No.: PCT/FR2005/001276

§ 371 (c)(1),
(2), (4) Date: Aug. 28, 2007

(87) PCT Pub. No.: WO2005/117799

PCT Pub. Date: Dec. 15, 2005

(65) Prior Publication Data

US 2008/0070757 A1 Mar. 20, 2008

(30) Foreign Application Priority Data

May 26, 2004 (FR) ..... 04 05700
Sep. 29, 2004 (FR) ..... 04 10279

(51) Int. Cl.
*A63B 22/00* (2006.01)
*A63B 22/02* (2006.01)
*A47D 13/04* (2006.01)
*A61H 3/00* (2006.01)

(52) U.S. Cl. ..... 482/69; 482/54

(58) Field of Classification Search ..... 482/51, 482/69, 54; 119/700; *A63B 22/00, 22/02; A47D 13/04; A61H 3/00*
See application file for complete search history.

(56) References Cited

U.S. PATENT DOCUMENTS

| | | | | | |
|---|---|---|---|---|---|
| 219,439 | A | * | 9/1879 | Blend | 601/23 |
| 1,919,627 | A | * | 7/1933 | Fitz Gerald | 482/7 |
| 2,819,755 | A | * | 1/1958 | Berger et al. | 482/69 |
| 3,761,082 | A | * | 9/1973 | Barthel, Jr. | 482/69 |
| 4,416,293 | A | * | 11/1983 | Anderson et al. | 600/595 |
| 4,655,447 | A | * | 4/1987 | Dubrinsky et al. | 482/69 |
| 4,861,021 | A | * | 8/1989 | Edwards et al. | 482/69 |
| 4,898,378 | A | * | 2/1990 | Edwards et al. | 482/54 |
| 5,158,510 | A | * | 10/1992 | Lemire | 482/51 |
| 5,162,029 | A | * | 11/1992 | Gerard | 482/71 |
| 5,176,597 | A | * | 1/1993 | Bryne | 482/74 |
| 5,411,279 | A | * | 5/1995 | Magid | 280/47.38 |
| 5,512,029 | A | * | 4/1996 | Barnard et al. | 482/129 |
| 5,542,892 | A | * | 8/1996 | Buhler | 482/54 |
| 5,603,677 | A | * | 2/1997 | Sollo | 482/69 |
| 5,662,560 | A | * | 9/1997 | Svendsen et al. | 482/69 |

(Continued)

FOREIGN PATENT DOCUMENTS

FR 2870746 A1 * 12/2005

(Continued)

*Primary Examiner* — Oren Ginsberg
(74) *Attorney, Agent, or Firm* — Browdy and Neimark, PLLC

(57) ABSTRACT

The invention relates to a device for the reeducation of motory deficiencies, comprising means for reeducation, characterized in that said device also comprises: means for maintaining the user; means for lightening the body weight of the user (27, 27'), exerting vertical traction, wherein the suspension point of said lightening means on the means for maintaining the user are located at the level of the center of gravity of the user, i.e. therebelow; and means for preventing the user from falling (21, 21'). The invention can be used to rededucate people how to walk.

11 Claims, 5 Drawing Sheets

U.S. PATENT DOCUMENTS

| | | | | |
|---|---|---|---|---|
| 5,667,461 | A * | 9/1997 | Hall | 482/69 |
| 5,788,606 | A * | 8/1998 | Rich | 482/27 |
| 5,941,800 | A * | 8/1999 | Laconis | 482/70 |
| 5,984,839 | A * | 11/1999 | Corkum | 482/54 |
| 6,146,315 | A * | 11/2000 | Schonenberger | 482/69 |
| 6,264,584 | B1 * | 7/2001 | Bass | 482/54 |
| 6,450,923 | B1 * | 9/2002 | Vatti | 482/8 |
| 6,554,747 | B1 * | 4/2003 | Rempe | 482/38 |
| 6,645,126 | B1 * | 11/2003 | Martin et al. | 482/54 |
| 6,666,798 | B2 * | 12/2003 | Borsheim | 482/54 |
| 6,821,233 | B1 * | 11/2004 | Colombo et al. | 482/54 |
| 6,837,186 | B1 * | 1/2005 | Terao | 119/700 |
| 7,086,996 | B2 * | 8/2006 | Matjacic et al. | 482/69 |
| 7,128,700 | B2 * | 10/2006 | Wallach | 482/130 |
| 7,341,543 | B2 * | 3/2008 | Dandy | 482/68 |
| 7,494,450 | B2 * | 2/2009 | Solomon | 482/69 |
| 7,614,991 | B2 * | 11/2009 | Fox | 483/54 |
| 2002/0130951 | A1 * | 9/2002 | Kurono | 348/61 |
| 2004/0005962 | A1 * | 1/2004 | Borsheim | 482/54 |
| 2004/0053756 | A1 * | 3/2004 | Tremayne | 482/126 |
| 2004/0087418 | A1 * | 5/2004 | Eldridge | 482/54 |
| 2004/0192511 | A1 * | 9/2004 | Ein-Gal | 482/54 |
| 2005/0255971 | A1 * | 11/2005 | Solomon | 482/54 |
| 2008/0058169 | A1 * | 3/2008 | Fox | 482/54 |
| 2008/0096745 | A1 * | 4/2008 | Perry | 482/148 |
| 2010/0035727 | A1 * | 2/2010 | Brunner | 482/8 |

FOREIGN PATENT DOCUMENTS

WO WO 2005117799 A1 * 12/2005

* cited by examiner

DEVICE FOR THE REEDUCATION OF MOTORY DEFICIENCIES, PARTICULARLY DEFICIENCIES WHEN WALKING, IN PATIENTS

BACKGROUND OF THE INVENTION

1. Field of the Invention

The present invention concerns a device for the reeducation of motor, or motor coordination, deficiencies in patients. It is more particularly, but not exclusively, applicable to reeducating people how to walk.

2. Description of the Prior Art

Generally, patients with neurological deficiencies following a central nervous system lesion (paraplegia and incomplete tetraplegia, hemiplegia of a vascular origin . . . ) lose, among other functions, the ability to walk.

Depending on the severity of the neurological lesion, a certain degree of motor and sensory recovery is possible and enables a certain recovery of the ability to walk, which, however, remains difficult in the majority of cases.

The objective of reeducation performed by a kinesiologist is to stimulate sensorimotor functions and body coordination with the goal of improving movement of the limbs and trunk.

After reeducation focused on isolated movements such as flexing and extension of the knee, the function in its entirety is reeducated, for example reeducation of how to walk.

The work of walking therefore begins after a certain time and is done with the feet on the ground and with permanent correction of movement provided verbally and physically. Different tools such as a walker, canes, parallel bars and splints can be used at different stages of progress.

For approximately ten years, a number of medical studies have demonstrated the interest of using a treadmill for reeducation of walking for these people. In the majority of these studies, the treadmill is used for walking exercise more intensively and repetitively than what is done in traditional reeducation. The presence of a therapist is useful in the beginning to help deficient limbs progress on the treadmill while correcting movement flaws. Walking on the treadmill is accompanied by some significant lightening of body weight, and this lightening is done by a traction system supporting the person using a harness worn on the trunk (thorax, abdomen and pelvis). By lightening the body weight, the patient's mass being constant, one understands that there is a decrease in the pressure corresponding to said mass on the treadmill.

One part of the traction system is located above the user; because of this, devices currently in existence are very bulky.

This system has advantages, in particular the possibility of practicing walking reeducation much earlier and more intensively (in terms of speed and endurance) than what is done with a traditional progression and technique. Indeed, the regular progress of the treadmill requires greater regularity of movement from the lower limbs during walking. The body weight may be lightened some in order to reduce, at first, difficulties related to balance.

The early nature of this system, which is immediately centered around walking, is clearly understood by the person, which increases his interest and motivation.

Walking reeducation is done without risk of falling, which reassures the patient, who can concentrate that much better on the quality of the motion.

Medical studies tend to show that this new method is more effective than traditional reeducation techniques in terms of recovering the quality of walking, meaning speed, ease, distance traveled. This effectiveness can be seen both in people who have been deficient for some time as well as those who have just suffered the neurological attack. The persistence over time of the positive effect after stopping this type of reeducation is unknown.

However, a number of drawbacks exist:

These systems are usually intended to be used by professionals and their costs are high, thus only hospital services can acquire them. Independent kinesiologists are not able to possess such devices, and private individuals even less so.

Moreover, long-term reeducation of people also raises problems. Patients who are unable to walk due to a problem of neurological origin manage to walk with some difficulty throughout their daily lives after reeducation and once they have returned to their homes.

Most often, patients walk to perform necessary trips and some, more motivated, walk more to perform actual exercise in order to better maintain, or even improve, their remaining ability to walk.

Likewise, to maintain these functions, doctors prescribe kinesitherapy sessions at home or in the office which, in practice, are sometimes too short and, after a certain time, limited in number by Social Security. Moreover, patients frequently spend part of the sessions performing exercises which are useful, but which often come at the expense of time devoted to work more specific to walking.

Overall, to make progress with walking or simply to maintain what has been acquired, it is necessary to walk more than is required by life at home (this is true both for ease and endurance). One notes that in practice, for many patients, this specific work is not intensive enough in terms of duration or intensity.

Clinical experience shows that most patients would be prepared to make more of an effort to improve their ability to walk, but that living conditions (lack of space to walk) and dependence on another person to go and walk outside (apprehension, risk of falling, climatic conditions, poor accessibility . . . ) often lead to confinement at home and very reduced amounts of walking.

In light of this observation, one may thus think that many people could benefit from walking training on a treadmill at home. This practice would make it possible to increase walking time by using a tool which is proving itself more and more in reeducation centers.

Practicing walking on a treadmill at home therefore has several potential advantages; however, in many cases, simple use of a treadmill by the patient alone is not feasible because there is no device making it possible to avoid falling, which can still occur on this type of device. Moreover, these treadmills do not integrate compact means for lightening the body and which are suitable for at-home use.

Indeed, a treadmill associated with body lightening means is a sizeable piece of equipment, in particular in terms of height, because the traction points and the rope attachments for the harness comprising said body lightening means are located above each shoulder; this device thus still comprises a sizeable portion located above the person's head. One part of the device is also located in front of or next to the body; this bulk is a disadvantage in the event the device is set up in a small space.

Such a device has the advantage of preventing any falls, but also the disadvantage of overly securing the user, who has no imbalance to compensate for. Walking, however, is largely based on an ability to compensate for a fall forward, in particular by moving one foot forward and balancing with the arms. Consequently, in this device, one important element of reeducation is not being exploited.

OBJECT OF THE INVENTION

The object of the invention is to resolve these disadvantages while leaving the user a certain freedom while making the user safe from falls.

SUMMARY OF THE INVENTION

To this end, it proposes a device for the reeducation of motor deficiencies, comprising means for reeducation, this device also comprising:

means for maintaining a user;

means for lightening the body weight of the user by exerting vertical traction, wherein the suspension point of said lightening means on the means for maintaining the user are located at the level or even below the center of gravity of the user, means for preventing the user from falling.

Said reeducation means may be a treadmill or any other reeducation device (stair simulator, cross-country ski simulator).

Said means for maintaining the user may include a harness comprising a belt element, straps for maintaining and/or supporting the legs attached to said belt element and means for connecting to the lightening means, these means being disconnectable and attached at the level of the belt element.

Said belt element may be located at the level of the center of gravity of the user, i.e. therebelow.

A number n of said means for connecting the harness to the lightening means may be distributed on the belt element.

According to a first variation, said means for connecting the harness to the lightening means may be two in number, each being located on a respective side of the belt element in such a way as to secure and raise the user while preserving a certain instability of the user favorable to reeducation.

According to a second variation, this instability may be better controlled: said means for connecting the harness may be greater than two in number, in particular four in number distributed on the sides of the belt element such that two of the means are on one side, one in front of, the other behind the user and that the two others are on the other side, one in front of, the other behind the user.

Thus, the vertical projection of the center of gravity of the user is located inside a support polygon, in the vicinity of its centre meaning a polygon made up by the vertical projections of each of the means for connecting the harness to the lightening means, on a horizontal plane. In other words, the device according to the invention makes it possible to keep the user inside the polygon, thereby creating a reduced stability zone in such a way as to keep the possibility of requiring the user to make an effort to maintain balance.

Said means for maintaining the user may also comprise support bars which enable the user to receive support with the upper limbs and thus increase stability. They may be adjustable in terms of height and/or size.

Said bars may be mobile or fixed.

Front and rear mobile bars may make it possible to reproduce forward and backward arm movement, such as takes place in normal walking.

These bars may comprise means from which the user, from a wheelchair, will be able to gain support to lift himself and install himself on the device according to the invention.

Said means for lightening the body weight of the user may comprise straps pulled in such a way as to exert upward traction on the means for maintaining. For example, traction force is applied using a reel around which one of the ends of the straps are wound, the other end being permanently attached on the means for maintaining the user.

Means for adjusting the traction force may be provided on one hand in order to maintain a constant traction force during exercise, the center of gravity moving during walking, and, on the other hand, to adapt said traction force to the user and/or therapeutic instruction.

Said prevention means may comprise straps and/or bars in order to prevent any lateral and/or frontal and/or rear falls.

Removable marks (40) may be positioned on the surface of the treadmill in order to provide an indication on the location where the foot should be placed during walking, thus encouraging the user to take steps of a certain length.

According to a first advantage, the device according to the invention is much less bulky than the devices of the prior art; it may therefore be set up and used in the patient's home.

Indeed, the height of the device does not exceed the height of the horizontal plane at the lower end of the sternum; there is therefore no structure of the device above the user's shoulders, which reduces its overall bulk.

Moreover, with a harness, installation constraints are less substantial than with a harness enveloping the pelvis, abdomen and part of the thorax.

According to a second advantage, it is easy for the patient to use with a health professional third party and later, depending on progress, alone or with a family member.

According to a third advantage, its cost is much lower than that of existing devices.

According to a fourth advantage, the device according to the invention may be flexible and/or folding.

BRIEF DESCRIPTION OF THE DRAWINGS

Embodiments of the invention will be described below, by way of non-exhaustive examples, with reference to appended drawings in which.

DESCRIPTION OF THE PREFERRED EMBODIMENTS

Figure 1:
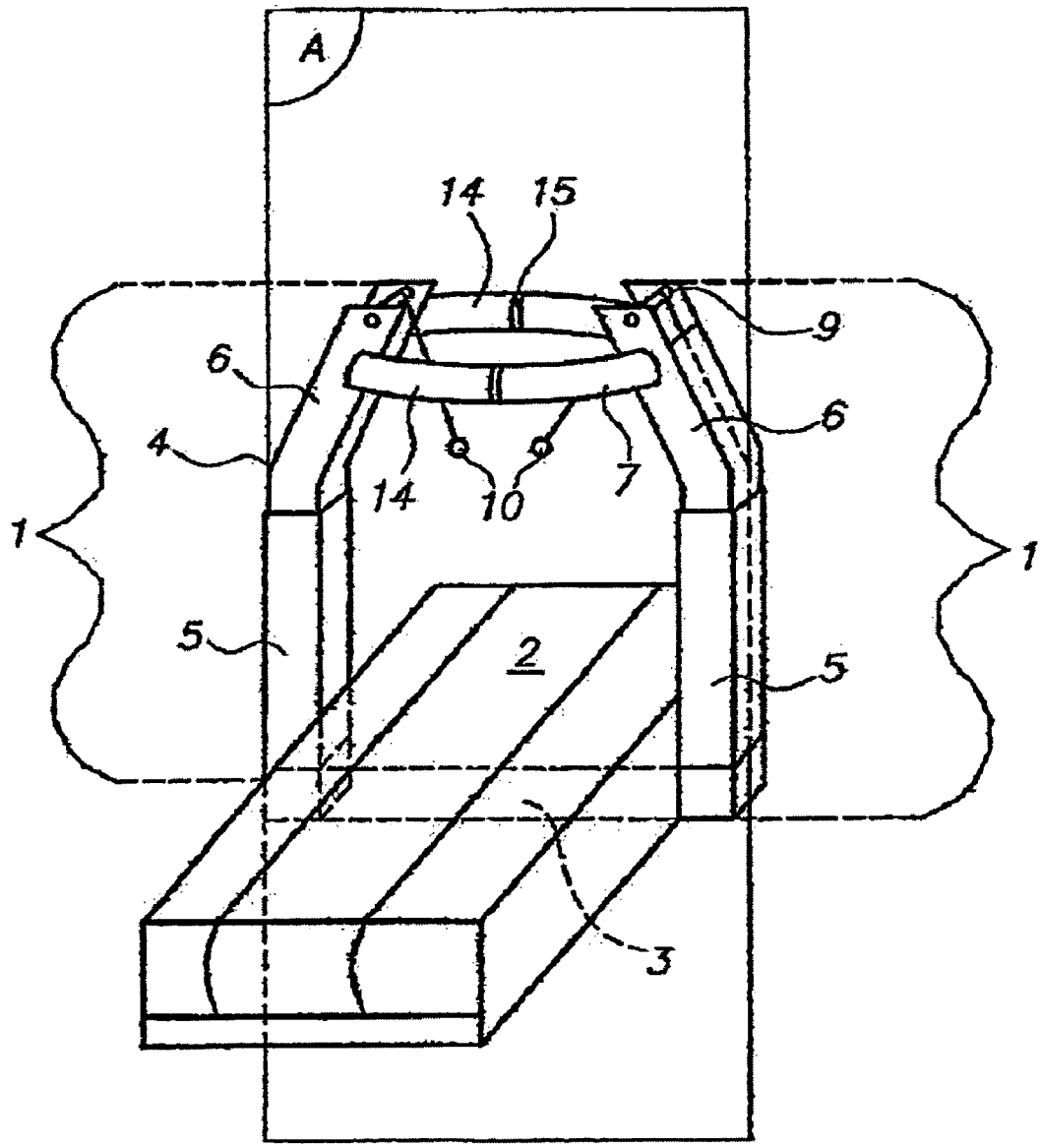
FIG. 1 shows an embodiment of the device according to the invention.

In the example of FIG. 1, the device comprises two lateral posts 1 in a parallelepiped section located on either side of a treadmill 2 possibly linked by a horizontal piece 3 going under the treadmill, this piece 3 being able to extend or retract in order to allow adjustment of the gap between the two posts closest to the user's trunk.

Moreover, these posts 1 each comprise a bend 4 in such a way as to bring their ends closer together and thus to adjust the size of the gap between said posts. It should be noted that each of the posts may comprise at least two mobile parts in vertical translation in relation to one another, one vertical 5 and the other bent 6, and having related attachment means at different levels in order to account for the height of the user such that the upper end of the posts is at the level of the navel.

Figure 3:
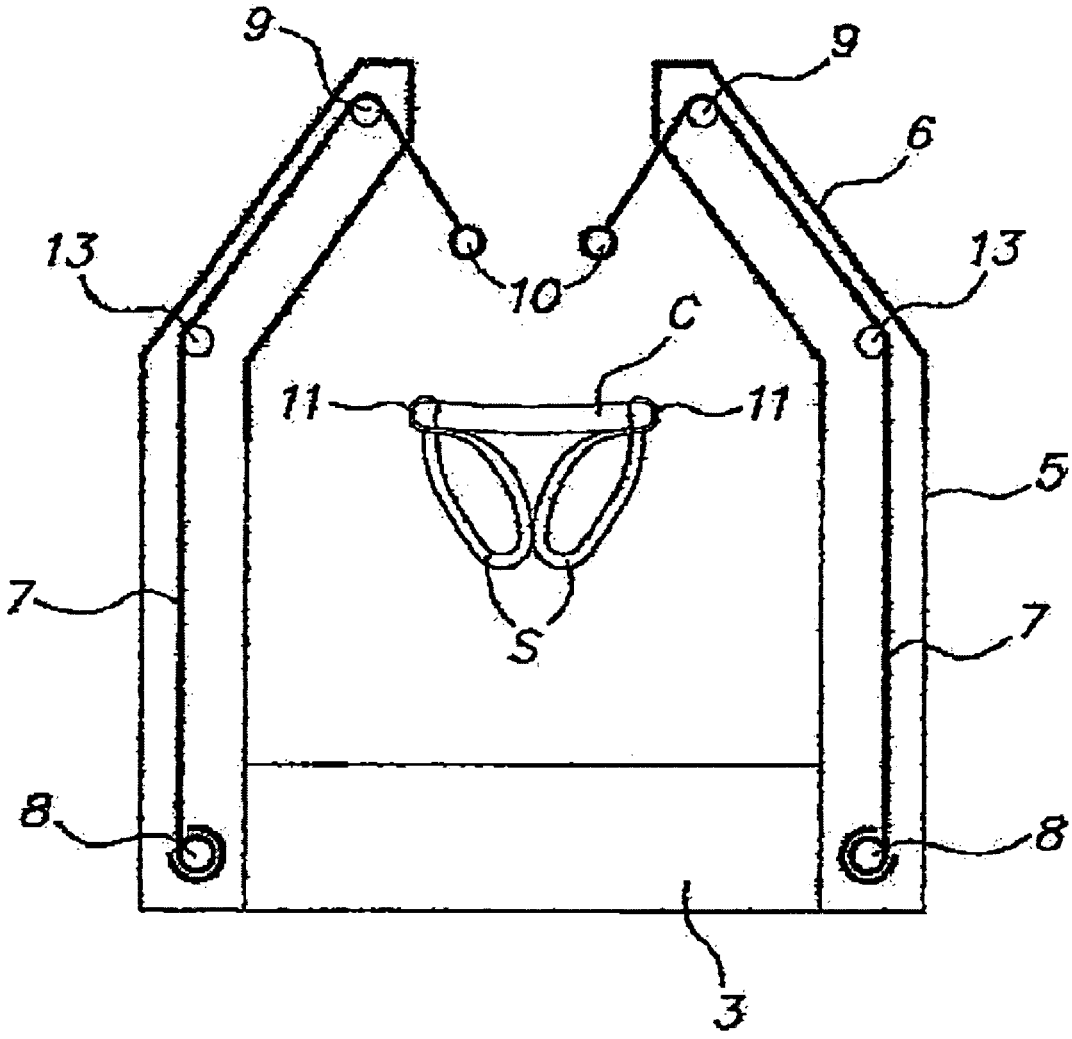
FIG. 3 is an illustration—of a cross-sectional view according to plan A of the device from FIG. 1.

Inside each of the posts is a strap 7 of which one of the ends is placed in a reel 8 located at the base of the post and of which the other extremity ends at the level of a pulley or a bar 9 located at the upper end of the post, meaning above the minimum height for positioning a harness, this end comprises disconnectable connection means 10 in addition to disconnectable connection means 11 located on said harness with which the user is equipped (FIG. 3). This harness also comprises a belt element C, and straps S to maintain and/or support the legs attached to said belt element C.

Thus, the ends of the straps 1 find themselves slightly above the position of the harness in such a way as to be able to exert upward traction on the harness.

It should be noted than an intermediate pulley 13 at the level of the bend 4 of the post 1 may be included.

Moreover, each reel 8 may also be located at the level of the upper end of the lateral posts 1.

These reels may be actuated and kept in position with the help of mechanical means or an electric motor.

Means to prevent falls are also attached at the ends of the lateral posts. They comprise at least two straps 14, one front, one back, one of the ends of each strap being attached at the level of the upper end of one lateral post 1 and the other end of each strap being attached at the level of the upper end of the other lateral post.

These straps 14 are positioned in such a way as to be located at the height of the navel, one facing the lumbar region, the other facing the abdomen. These straps each comprise disconnectable connection means 15 to allow easier set-up by the user.

Figure 2:
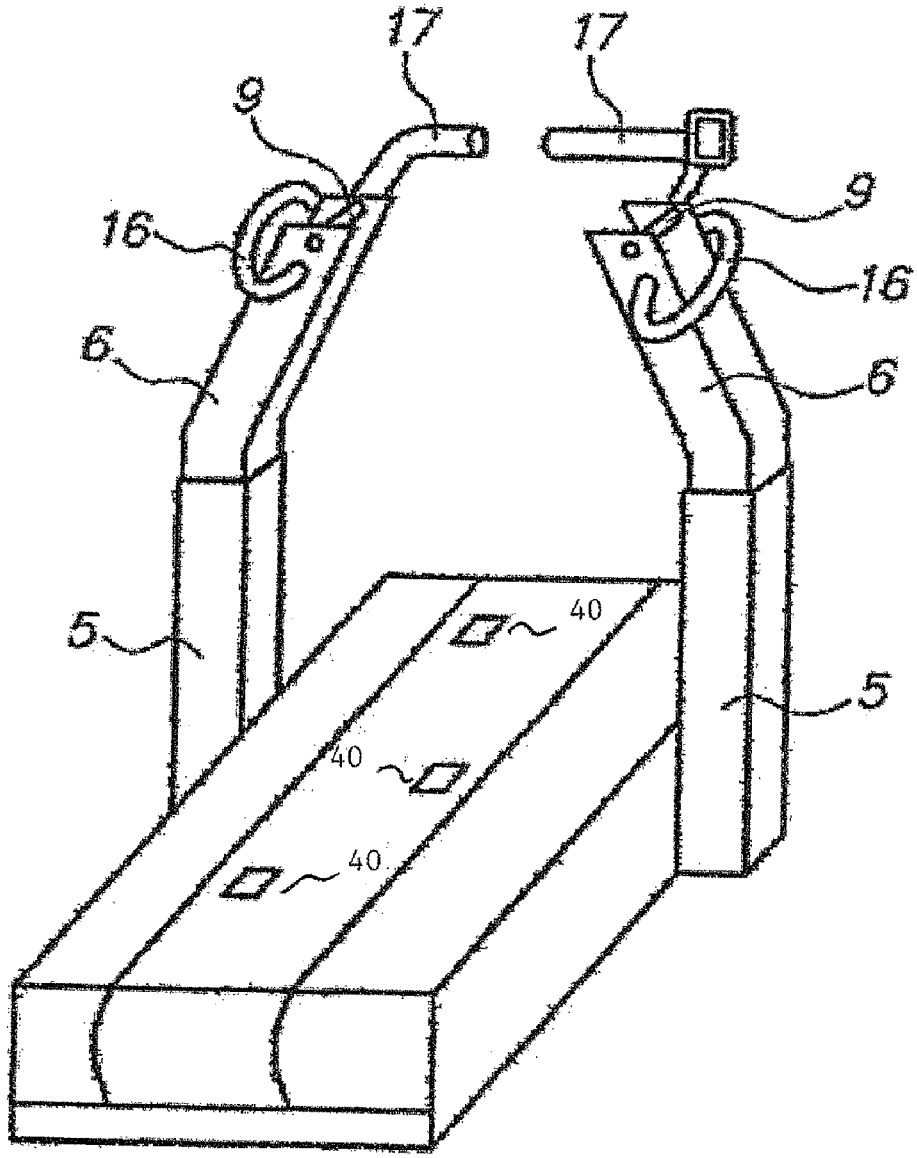
FIG. 2 shows a second embodiment of the device according to the invention.

Support bars or handles, lateral 16 or rear 17, placed in front of the user may be included, these bars or handles being mounted on the lateral posts and the user thus being able to grab them with the hands in order to take support from them (FIG. 2).

Figure 4:
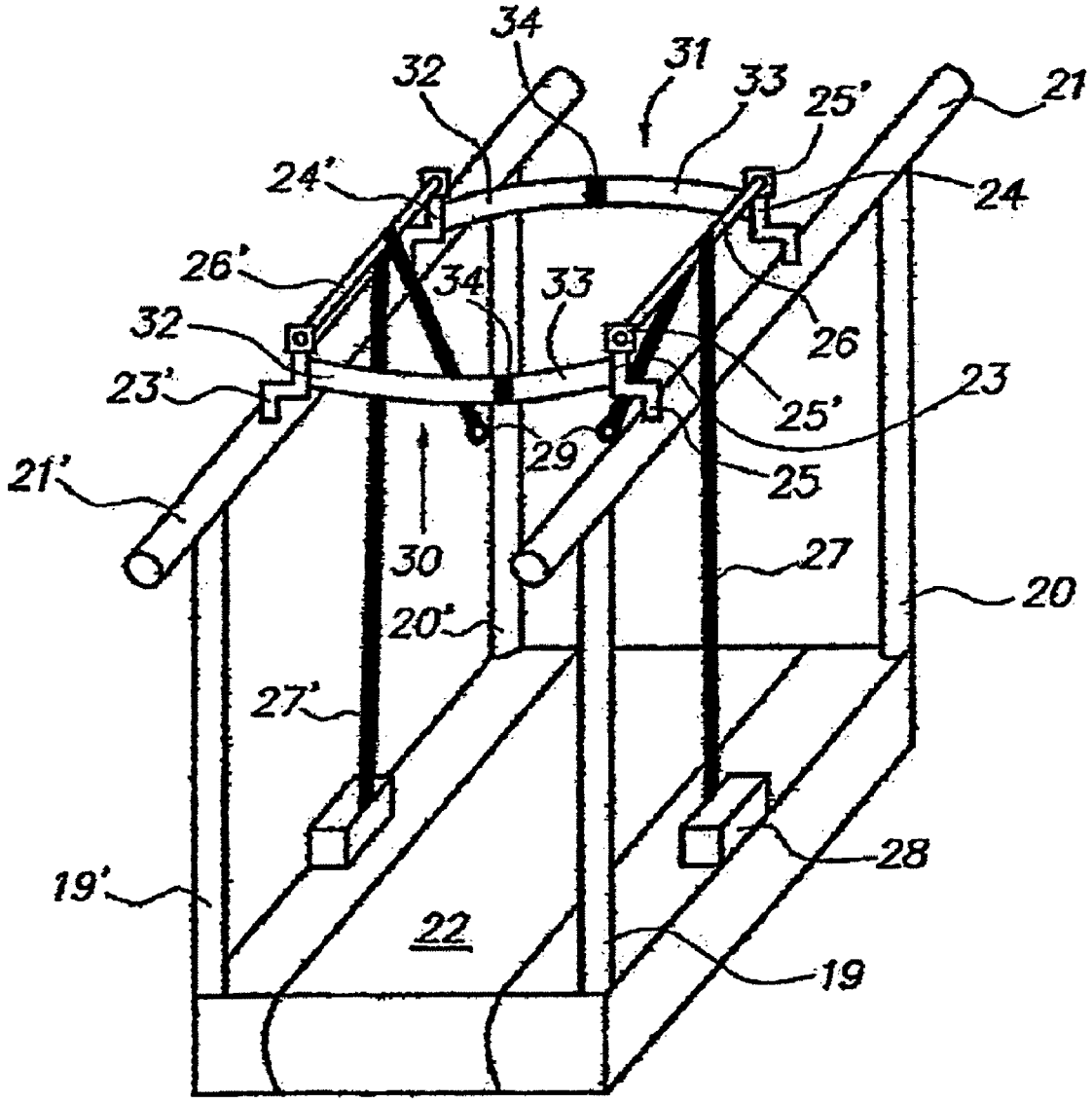
FIG. 4 shows a third embodiment of the device according to the invention.

The example of FIG. 4 illustrates another embodiment of the device according to the invention.

In this example, lateral posts 18, 18' are fixed in relation to one another.

Each post comprises two vertical bars 19, 19', 20, 20' linked at the level of their peaks by a horizontal bar 21, 21', the axis of which is collinear to the displacement axis x of a treadmill 22.

Each horizontal bar 21, 21' comprises two bars with two bends, forward 23, 23' and rear 24, 24' respectively, centered vertically, the lower ends of these double-bent bars are attached on the horizontal bars 21, 21' by a joint 25 comprising a "rotational" axis collinear to that of the horizontal bars 21, 21', the upper ends of these double-bent bars 23, 23', 24, 24' are also linked by a horizontal bar 26, 26' via a joint 25' identical to that already described, this bar being at a height greater than the minimum attachment height of the harness.

The double-bent bars 23, 24 of one lateral post 18 are arranged in pairs opposite the double-bent bars 23', 24' of the other lateral post 18'.

The traction straps 27, 27' attached to the harness to make it possible to lighten the weight of the user each comprise one of their ends at the level of the base of the lateral posts which here constitute the base of the treadmill, this end being kept in a reel 28, 28' so as to be able to adjust the traction force supplied to support the user's harness.

Each of the straps 27, 27' is then passed around each horizontal bar 26, 26', which plays the role of a return pulley for the strap 27, 27' toward the harness, the ends of the traction straps and the harness comprising disconnectable connection means 29 and 11 respectively.

Straps 30, 31 are also provided as prevention means to prevent the user from falling forward or backward. They comprise two parts 32, 33 connected using disconnectable connection means 34.

The forward straps 30, meaning those located at the height of the navel facing the abdomen, are attached on the two double-bent bars 23, 23' located across from one another in front of the horizontal bars 21, 21'.

The rear straps 31, meaning those located at the height of the navel facing the lumbar region, are attached on the two double-bent bars 24, 24' located across from one another behind the horizontal bars 21, 21'.

It should be noted that these straps 30, 31 may be replaced by rigid bars and bends in the shape of a hoop attached at one end on one of the lateral posts using a vertically-centered joint, making it possible to move them to the side during user set-up.

Figure 5:
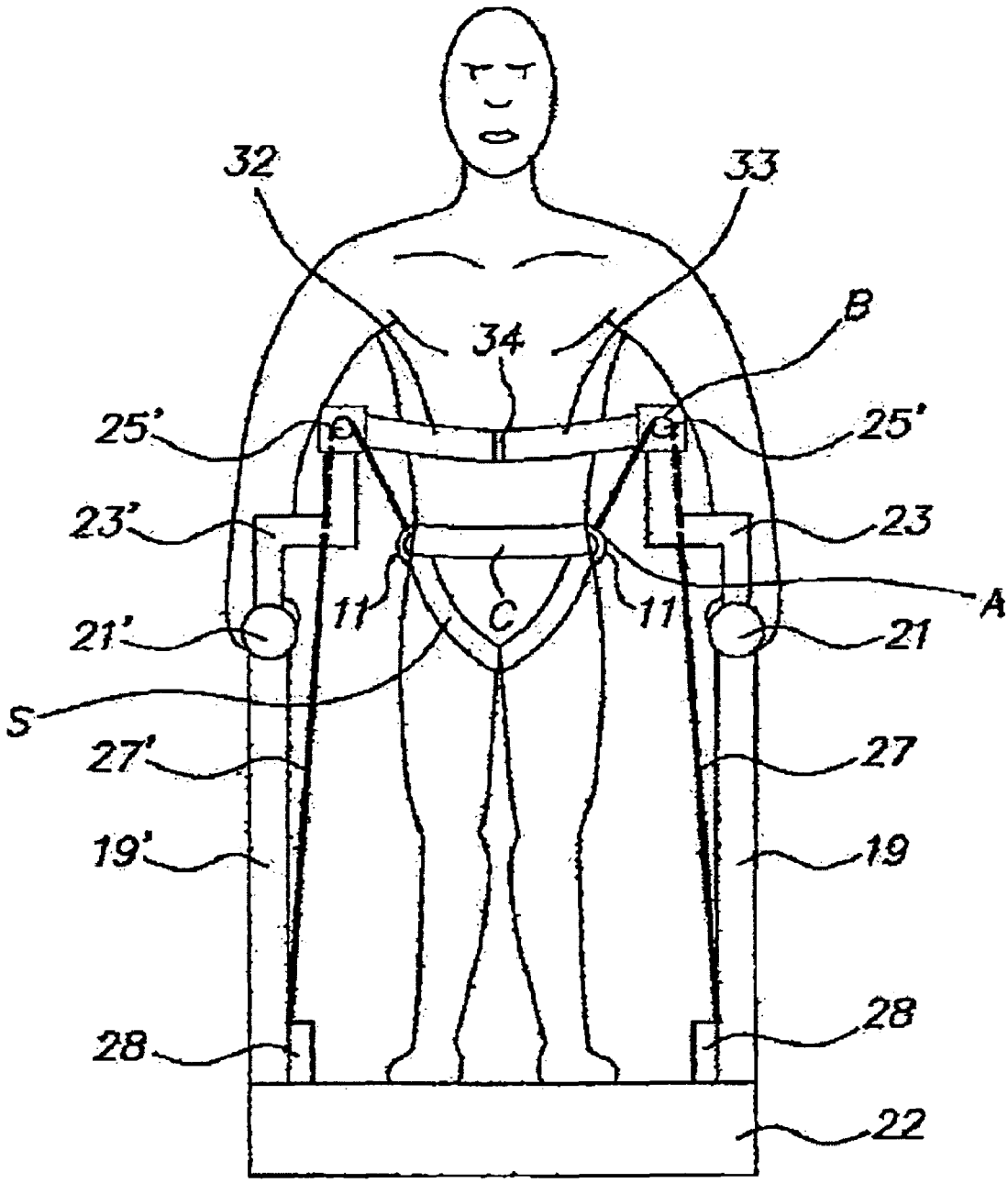
FIG. 5 is an illustration of the device from FIG. 4 in operation.

The operation of the device shown in FIG. 1 or 5 is the following:

Each part of the device makes is possible to perform an action on the subject, the principle of which is the following:

The harness is attached to the straps 27 on both sides of the subject, at the level of a point A located above the greater trochanter, substantially at the level of the iliac crest.

Each strap 7, 27, 27' is then directed toward a point B defined by a precise position in the extracorporeal space, it is located laterally at several centimeters from the abdomen on a frontal plane and at a height located slightly above the navel.

On an upright subject in an anatomical position, point B toward which the strap is directed is located between the elbow and the trunk.

Materially, point B is included in the bar or pulley 9, 26, the strap 7, 27, 27' pushes on it to change direction to rejoin a reel 8, 28 located at the level of the base of the lateral post 1, 18, 18'.

This reel comprises a spiral spring and means to more or less bend said spiral spring (not shown in the figures) in order to exert traction on the straps (7, 27, 27'), according to the mass of the user and/or therapeutic instructions.

This traction may also be kept constant during exercise.

Said means to more or less bend said spiral spring may be manual or electric such as an electric motor.

This traction device for the strap may be located at any place on the device once it makes it possible to exert, at the level of point A, upward traction on the frontal plane in order to raise the pelvis.

The pelvis is raised bilaterally, which enables the device to support one part of the body mass of the subject.

The other specific characteristic of the device is to ensure that the subject is held in case of a fall. Wearing the band and the ascending traction of the pelvic already make it possible to hold back a fall, but only partially; indeed, the body can still fall forward or backward around an axis linking the two points A.

The straps 14, 30, 31 prevent a complete fall by holding the body in front and in back. Indeed, they join the two points B by moving in front of and behind the subject at the height of the navel.

Removable marks (40) may be positioned on the surface of the treadmill in order to provide an indication of the location where the foot should be placed during walking, thus encouraging the user to take steps of a certain length.

The invention is not limited to the aforementioned examples.

Indeed, the horizontal bars 21, 21' may have a shape allowing the user in a wheelchair to acquire support to lift himself and move into the device according to the invention. This may involve an extension in a C-shape.

The invention claimed is:

1. A device for helping a user relearn his or her balance and regain the ability to stand or walk, comprising:

a user support member providing a support surface on which the user can stand;

two upright members between which said user support member extends, each of said uprights having an upper end that is not higher than the user's shoulders when the user is standing on the support surface;

a harness configured and dimensioned to be worn by the user to surround the user's legs, said harness having at least two connection members each associated with a respective upright member, said connection members being located at the height of, or below, the center of gravity of the user when said harness is being worn by the user;

traction means connectible to said connection members for exerting an upward force on said harness and thus on the user, said traction means comprising two straps each extending downwardly from a guide element carried by a respective upright member at a location above said connection members and each strap having one end connectable to a respective connection member; and protective members separate from said harness and including a front protective member disposed to prevent the user from falling forward and a rear protective member disposed to prevent the user from falling backward, said front and rear protective members being mounted to be substantially at the level of the navel of the user.

2. The device according to claim 1, wherein said user support member comprises a treadmill.

3. The device according to claim 1, wherein said harness comprises: a belt element; and straps to maintain and support the user's legs attached to said belt element, wherein said connection members are disconnectable from said traction means and are disposed at the level of said belt element.

4. The device according to claim 3, wherein said belt element is located to be at the level of, or below, the center of gravity of the user when said harness is being worn by the user.

5. The device according to claim 3, wherein said connection members comprise two connection members, each located at a respective side of said belt element.

6. The device according to claim 1, wherein said traction means comprise traction force generating means coupled to said straps for exerting an upward traction force on said harness when said straps are coupled to said harness.

7. The device according to claim 1, said traction means comprise two reels around each of which is wound the other end of a respective one of said straps.

8. The device according to claim 1, wherein said protective members are straps or bars in order to prevent the user from falling forward or backwards.

9. The device according to claim 1, wherein said user support member comprises a treadmill provided with removable marks that provide an indication of where the user's feet should be placed while walking.

10. The device according to claim 1, further comprising means for adjusting the traction force produced by said traction means.

11. The device according to claim 10, wherein said two connection members are each located at respective sides of said harness and said means for adjusting the traction force comprise two separate traction devices each connected to a respective one of said connection members.

* * * * *